US007559588B2

(12) United States Patent
Liang

(10) Patent No.: US 7,559,588 B2
(45) Date of Patent: Jul. 14, 2009

(54) WINDOW VENT STOP

(76) Inventor: Luke K. Liang, 7 Tulip Dr., Glen Cove, NY (US) 11542

( * ) Notice: Subject to any disclaimer, the term of this patent is extended or adjusted under 35 U.S.C. 154(b) by 1096 days.

(21) Appl. No.: 10/023,474

(22) Filed: Dec. 17, 2001

(65) Prior Publication Data

US 2003/0167694 A1 Sep. 11, 2003

(51) Int. Cl.
*E05C 17/44* (2006.01)
*E05C 17/54* (2006.01)

(52) U.S. Cl. ..... 292/342; 292/338; 292/339; 292/343; 292/DIG. 15; 49/449; 16/82

(58) Field of Classification Search ..... 292/342, 292/338, 339, 343, DIG. 15, DIG. 47, DIG. 46, 292/DIG. 56; 49/176, 449; 16/82, 86 R, 16/86 A See application file for complete search history.

(56) References Cited

U.S. PATENT DOCUMENTS

| | | | | | |
|---|---|---|---|---|---|
| 534,185 | A * | 2/1895 | Winchester | 292/63 |
| 1,646,181 | A * | 10/1927 | Babekuhl | 70/100 |
| 1,656,818 | A * | 1/1928 | Dillon | 292/238 |
| 3,172,168 | A * | 3/1965 | Suska | 49/400 |
| 3,805,322 | A * | 4/1974 | Serrano | 16/82 |
| 4,824,154 | A * | 4/1989 | Simpson | 292/338 |
| 4,923,230 | A * | 5/1990 | Simpson | 292/67 |
| 5,248,174 | A * | 9/1993 | Matz et al. | 292/338 |
| 5,536,052 | A * | 7/1996 | Maier | 292/63 |
| 5,553,903 | A * | 9/1996 | Prete et al. | 292/163 |
| 5,575,116 | A * | 11/1996 | Carlson et al. | 49/449 |
| 5,806,900 | A * | 9/1998 | Bratcher et al. | 292/137 |
| 6,364,375 | B1 * | 4/2002 | Szapucki et al. | 292/63 |
| 6,572,158 | B2 * | 6/2003 | Szapucki et al. | 292/221 |

* cited by examiner

*Primary Examiner*—Carlos Lugo
(74) *Attorney, Agent, or Firm*—Thomas A. O'Rourke; Bodner & O'Rourke, LLP

(57) ABSTRACT

An improved vent stop for use in sliding sash windows or sliding doors. The vent stop has a housing adapted to be disposed in a recess of either a door or window. This housing includes a cavity with a bottom plate therein. Inside the cavity is a tumbler that may be in a retracted position, to allow the sash or door to move, and an extended position to prevent the sash or door from moving. The tumbler may move from the retracted position to the extended position via at least one pivot connection. Also within the housing is a spring for biasing the tumbler into the extended position. The tumbler has a pivot member that has a bottom plate contact surface that contacts a side edge of the bottom plate when the tumbler is in an extended position, thus preventing further travel of the tumbler.

27 Claims, 4 Drawing Sheets

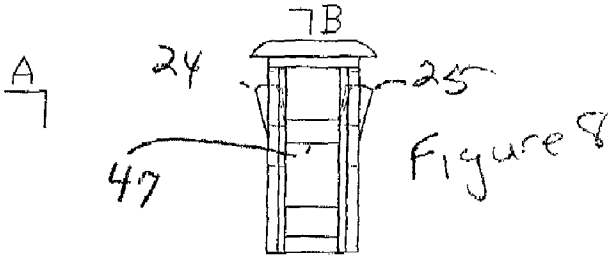
Figure 8
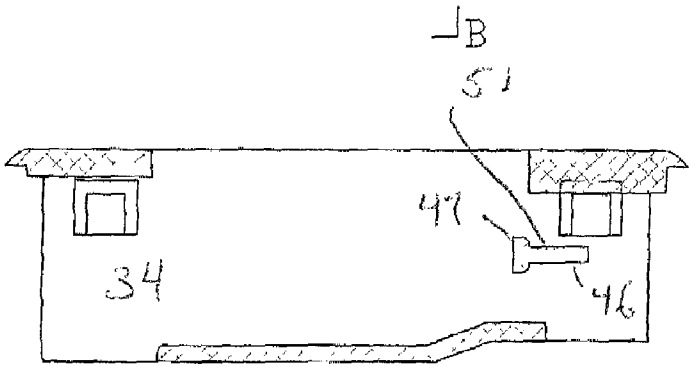
Figure 9
B — B
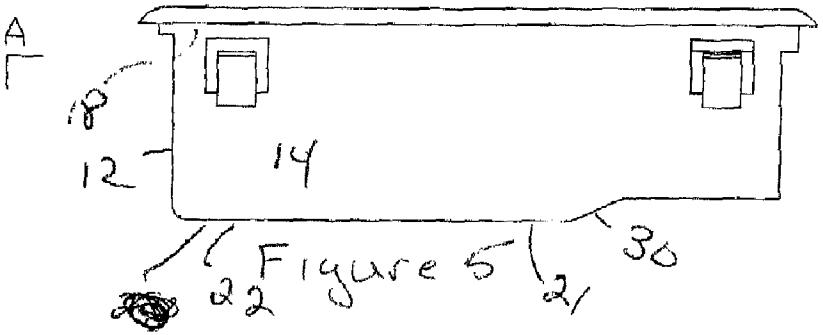
Figure 5
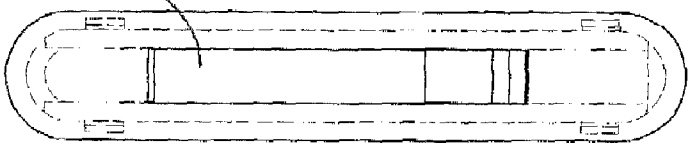
Figure 6
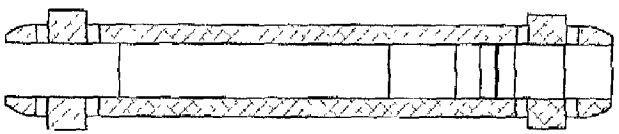
A—A Figure 7

A
B – B
C–C
2:1

D–D
2:1

A
B
C
D
35
36
37
38
39
40
41
43
44
45
50
53
54
58

WINDOW VENT STOP

FIELD OF THE INVENTION

The present invention relates to improvements in window vent stops for double hung windows and the like to prevent the window or door from opening more than a desired amount.

BACKGROUND OF THE INVENTION

There are a number of different types of windows and doors that are currently available. These windows include casement windows, transom windows, single hung window, double hung windows, sliding windows, etc. Double hung windows are windows that have a pair of window sashes that may be raised and lowered. Each sash resides in a pair of tracks or recesses that are typically at each side edge of the window. This permits the lower sash to be raised and the upper sash to be lowered. Traditionally, most windows were made of wood. more recently, the windows including the window sashes have been made of extruded metal or plastic.

Double hung windows originated years ago before the days of air conditioning as a means for cooling a room during the warmer weather. The concept of a double hung window takes advantage of the fact that warm air rises and cooler air is lower in a room. Thus in a room with a double hung window the warm air exits from the opening formed by the lowering of the upper sash and the cooler outside air enters the room through the opening formed by the raised lower sash. In many older buildings the double hung windows may be relatively high and extend from nearly the floor to the ceiling in many rooms. More recently in many buildings, the original concept of the double hung window has been abandoned. Now, most people only open the lower sash to let air either into or out of a room. One reason for this is that many owners of buildings with double hung windows have installed storm windows over the outside of the double hung windows. The storm windows are very useful in reducing the influx of cold air during the cooler months. However, because the annual installation of storm windows has become such a chore, most people have installed the storm windows that store the panes of glass adjacent the upper sash of the storm window. Even in heavily insulated double hung windows that are sold today where there is no need for storm windows typically only the lower sash is raised.

Single hung windows are similar in design to double hung windows except that there is only one sash that may be raised or lowered. Sliding windows are also not unlike double hung windows in design. While a double hung window has sashes that are raised and lowered a sliding window has sashes that are movable along a track to the right or left. Similarly, sliding doors operate the same way as sliding windows.

Double hung windows, single hung windows, sliding windows and sliding doors have a variety of open positions in which they may be placed. While a fully opened position can be desirable for ventilation purposes there can be a downside to the fully opened position. One downside is security. A fully open window or door, however, can be a location for unauthorized ingress and egress from the premises. For example, a double hung window that is opened wide can be a source of danger to small children who may climb up to the window. As a result, many municipalities have enacted laws requiring window guards. Additionally, an opened window or door can provide an invitation to third parties to gain access to the building. As a result, there are a number of vent stops that are available to secure a window or door having sliding members in a partially opened position. One such stop is shown in U.S. Pat. No. 5,248,174 owned by Ashland Products. Another sash stop is shown in U.S. Pat. No. 4,923,230 owned by Ro Mai. In each of these sash stops there is a spring biased tumbler or dog that pivots from an unlocked position to a locked position as desired. These sash locks are positioned in the frame of the upper sash and when the tumbler is pivoted outwardly the position of the tumbler prevents the lower sash from being raised above a preselected position. Other prior art patents for similar products a U.S. Pat. Nos. 5,553,903 and 5,806,900 both of which are owned by Ashland.

While the vent stops of the prior art are generally satisfactory in operation there is a need for improved vent stops that are stronger and more dependable than the prior art vent stops. It is not uncommon for such prior art vent stops to be hit rather hard as one sash is moved and as a result, there have been instances where casing of the vent stop cracks open and the tumbler and/or the spring of the prior art stops become dislodged. The problems of the prior art stops is solved by the vent stop of the present invention which has superior strength due to its improved construction.

OBJECTS OF THE INVENTION

It is another object of the present invention to provide a vent stop that is more durable than the prior art vent stops.

It is an object of the present invention to provide an improved vent stops that is easier to operate than the prior art vent stops.

It is an object of the present invention to provide a vent stop that provides a stronger restraint to movement of the sash or door than the prior art vent stops.

It is still another object of the present invention to provide a vent stop that is safer to use than prior art vent stops in that it is better able to prevent the sash from being opened an amount greater than desired.

It is a still further object of the present invention to provide a vent stop that has a tumbler that is less likely to become separated from the vent stop housing during use than prior art vent stops.

SUMMARY OF THE INVENTION

The present invention is directed to an improved vent stop for use in a sliding sash window assembly or a sliding door assembly. The window may have one or more sashes usually an upper and lower sash window frames installed for vertical sliding movement. Alternatively, the window may have a left and right horizontal sliding sashes. The door may also have one or more sliding doors. One sash frame or sliding door frame has a recess into the interior thereof. The vent stop has a housing adapted to be disposed in the recess. This housing includes a cavity with a bottom plate therein. Inside the cavity is a tumbler that may be in a retracted position and an extended position. When the tumbler is in an extended position the tumbler has a protruding apex at the top. The tumbler has at least one pivot means for pivotally securing said tumbler to said housing for movement between the extended position and the retracted position. In the extended position the bottom of the tumbler overlies a portion of the second sash to prevent movement of the lower sash past the tumbler. When in a retracted position within said cavity the sash or door can be raised and/or moved past the tumbler without interference. Also within the housing is a spring means for biasing said tumbler into said extended position. The tumbler's pivot member has a bottom plate contact surface that contacts a side edge of the bottom plate when said tumbler is in an extended position thereby being prevented from further travel by the side edge of the bottom plate.

BRIEF DESCRIPTION OF THE DRAWINGS

FIG. 5 is a side view of the housing of the vent stop of FIG. 1.

FIG. 6 is a top view of the housing of FIG. 5.

FIG. 7 is a sectional view of the housing of FIG. 5 taken along A-A

FIG. 8 is an end view of the housing of FIG. 5.

FIG. 9 is a sectional view of the housing of FIG. 8 taken along B-B

FIG. 10 is a side view of the tumbler of the vent stop of FIG. 1

FIG. 11 is an end view of the tumbler of FIG. 10.

FIG. 12 is a top view of the tumbler of FIG. 10.

FIG. 13 is a side view of the tumbler taken from the opposite side of the view of FIG. 10.

FIG. 14 is a sectional view of the tumbler of FIG. 10 taken along B-B.

FIG. 15 is a sectional view of the tumbler of FIG. 10 taken along C-C.

FIG. 16 FIG. 15 is a sectional view of the tumbler of FIG. 10 taken along D-D.

DETAILED DESCRIPTION OF THE PRESENT INVENTION

Figure 1:
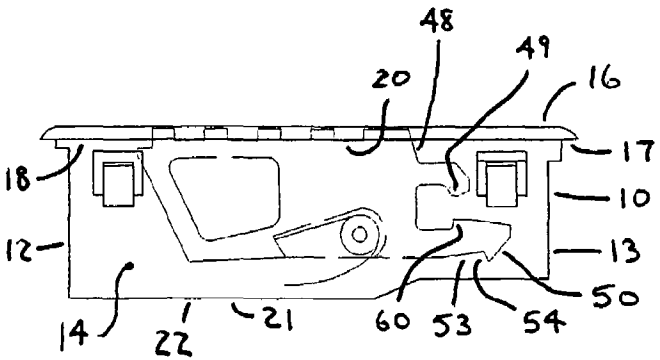
FIG. 1 is a side view of the vent stop of the present invention.

The window or door assembly that may employ the vent stop of the present invention may be a conventional double hung window, a single hung window, sliding window, sliding door and the like. For convenience the present invention will be described with reference to a double hung window but the same applies to each of the above other types of windows and doors having at least one sliding member. The double hung window usually includes upper and lower sash window frames, that are provided with suitable glazing to protect and bed the glass. The sashes are conventionally mounted within a main jamb frame for vertical reciprocal sliding movement therein. Sliding windows and doors are mounted for horizontal reciprocal sliding. Both the jamb frame and the sashes and can be formed of different materials, such as metal or strong and rigid plastics well known in this field. The sashes and are preferably fabricated from elongate framing members of hollow configuration and are generally rectangular in cross-section and rectilinear in configuration, but the shapes and configurations can vary. The upper sash includes a stile, and the lower sash includes a header having an upper exterior surface. The vent stop of the present invention is designated generally in FIG. 1 by reference numeral 10. This vent stop may be installed in the exterior front surface of the sash stile, and engaging the upper exterior surface of the header of the lower sash, in its locking position. It will be appreciated that the vertical location of the vent stop in the stile will depend upon the amount of vertical movement of the lower sash that is desired before the upper header surface engages the vent stop.

The vent stop 10 includes a housing 12 that retains the mechanism of the stop. The housing is installed in an opening or recess in the front surface of the sash stile. The housing 12 may have a front wall, rear wall 13 and first and second housing members 14 and 15. On the top surface of the housing is a faceplate 16 which has a lip portion 17 that overlaps the peripheral edge of the recess to support the housing 12 therein and to furnish an attractive exterior appearance and protect any rough edges in the opening in the sash stile. The first housing member 14 and a second housing member 15 extend downwardly from the under surface 18 of the faceplate 16. Each of the first and second housing members have a top edge 20 and a bottom edge 21. Preferably extending across from the bottom edge 21 of the first housing member to the bottom edge of the second housing member is a bottom plate 22. The bottom plate 22 need only extend across a portion of the area between the bottom edges of the housing members. In addition it need not have a continuous surface and may have one or more openings as desired.

The first and second housing members 14 and 15 preferably have one or more retaining pins 24 and 25 that extend outwardly from the exterior surface 26 of the housing members. These pins 24 and 25 are preferably flexible and give slightly to permit the vent stop to be inserted into the opening in the sash. The gap 27 between the underside 18 of the faceplate 16 and the upper surface of the pin is preferably generally about the thickness of the material used in the sash stile or slightly less. The retaining pins are designed so that when the vent stop is snapped into the opening in the sash the pins will retain the vent stop in position and not be removed easily. The faceplate 16 is preferably formed as a solid one piece member and is configured to project only slightly forward of the front surface of the stile so as not to interfere with the relative sliding movement of the sashes. The faceplate 16 may be provided with a curved outer peripheral edge 26, however it will be appreciated that the outer peripheral edge may be any configuration besides curved as is desired.

The bottom edge of the first and second housing members preferably have a first base section 28, a second base section 29 and an angled section 30 joining the first and second base sections. However, it will be appreciated by those skilled in the art that the configuration of the bottom plate 22 can vary. There is a gap between the rear edge 31 of the second base section and the inside surface 32 of the rear wall 13.

Figure 3:
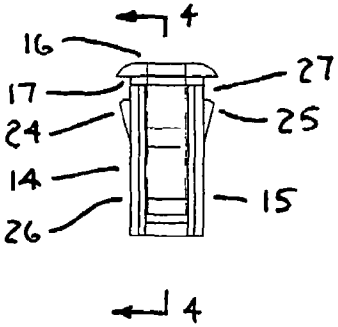
FIG. 3 is an end view of the vent stop of FIG. 1.

The faceplate 16 includes a centrally located generally elongate vertical opening 33 which is in communication with an interior cavity 34 of the housing 11. An oblong tumbler 35 is mounted within the cavity 34 to pivot therein and to lockingly engage the upper exterior surface of the lower sash header as the lower sash header is raised. The tumbler has a top surface 36 that is preferably serrated with a plurality of raised sections 37 and valleys 38. The raised sections and valleys provide a surface for fingers of the user to conveniently operate the stop and raising and lowering the tumbler from a activated position to an inactivated position. The top surface 36 of the tumbler preferably has a tab 39 that can be retained by the underside of the faceplate 16 and thus keep the tumbler in an inactivated position. In order to retain the tumbler in an inactivated position, the tumbler may be shifted laterally so that the tab 39 is positioned under the faceplate. When it is desired for the tumbler to be raised into an activated position, the tumbler is shifted slightly laterally to position the tab 39 away from the underside of the faceplate thus permitting the tumbler to spring upwardly into an activated position. The action of the tab 39 with respect to the underside of the faceplate is shown in more detail in FIGS. 1 and 3. FIG. 1 shows the tumbler in a retracted position while FIG. 3 shows the tumbler in a raised position.

Figure 18:
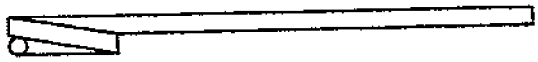
FIG. 18 is an end view of the spring of FIG. 17.
Figure 17:
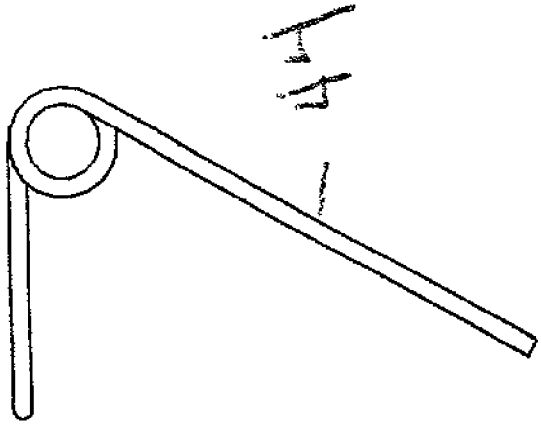
FIG. 17 is a side view of a spring that may be used with the present invention.

The tumbler 35 has a bottom surface 40 and a front face 41 that extends from the tip of the tab 39 to the bottom 40. The front face is angled as shown in the Figures to permit the tumbler to easily move from an inactivated to an activated position. The angled face 41 prevents the tumbler from hitting the edge 42 of the faceplate when the tumbler is moved from an activated position to an inactivated position. The bottom 40 of the tumbler is provided with a recess 43 for receiving one end of a spring 44 that forces the tumbler into a locked position when the tumbler is released from the unlocked position of the vent stop. A preferred type of spring is a leaf spring shown in FIGS. 17 and 18. However, it will be appreciated by those skilled in the art that other types of springs may be used.

Figure 2:
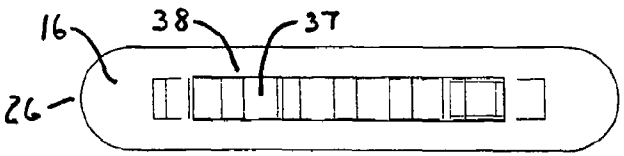
FIG. 2 is a top view of the vent stop of FIG. 1.
Figure 4:
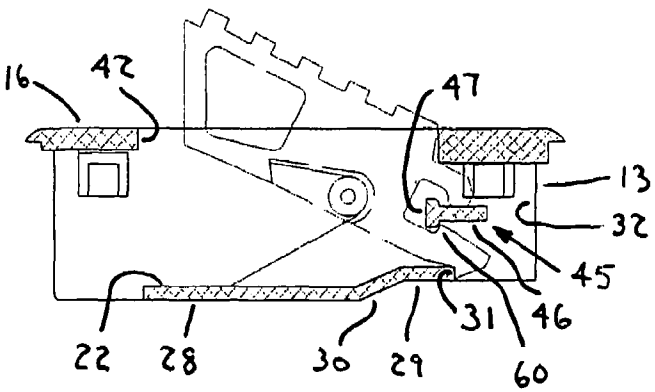
FIG. 4 is a sectional view of the vent stop of FIG. 3 taken along B-B.
Figures 10, 11, 12, 13, 14, 15, 16:
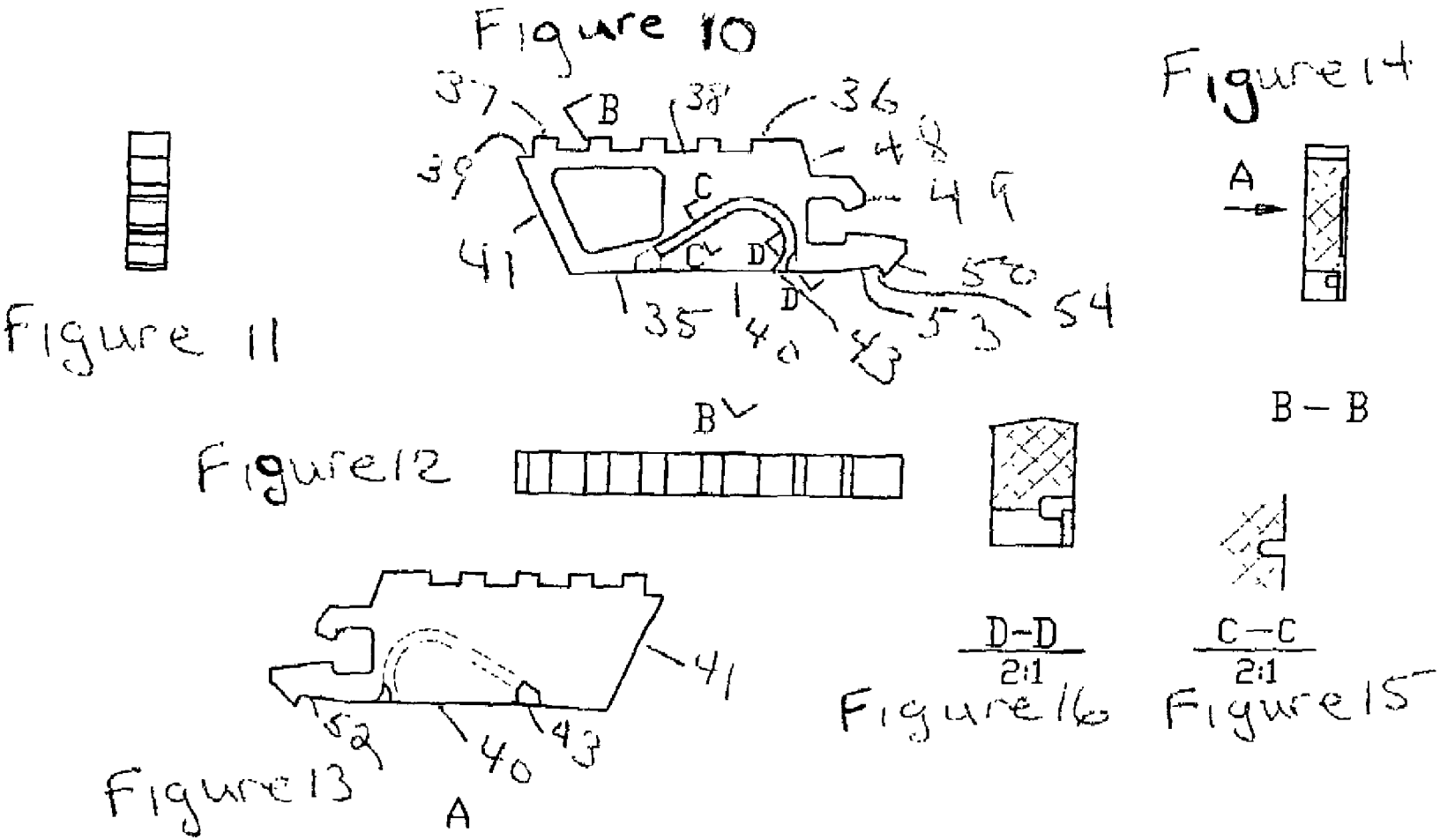

The tumbler 35 pivots about pin 45. The pin may extend from one inside wall of the first and second housing members to the other. Preferably, the pin 45 extends only from one side of the inside surface of one of the housing members. The pin may be any shape but preferably is "T" shaped with a side member 46 extending from vertical member 47. The rear end 48 of the tumbler has a first pivot member 49 and a second pivot member 50. When the tumbler is released from the housing, the first pivot member 49 rotates about the pin. When the first pivot member hits the upper surface 51 of the side member 46 the tumbler is prevented from further rotation. The second pivot member 50 extends from the tumbler and also rotates as the tumbler is released. The second pivot member 50 has a bottom plate contact surface 52 and may additionally or alternatively have a pin contact protrusion 60 (see FIGS. 2 and 4). The bottom plate contact surface has a bottom wall 53 and a side wall 54. The second pivot member 50 hits the bottom plate 22 in at least one and preferably two locations. One location is the edge 31 of the bottom plate and the other is the top surface 55 of the bottom plate when the tumbler is in a venting position. The bottom plate prevents the tumbler extending further outwardly from the housing and reducing the risk of the tumbler separating from the housing of the vent stop. It has been found that the force exerted by second pivot member 50 on the bottom plate 22 is such that there is a risk that the bottom plate 22 may become distorted over time thus causing the second pivot member to rotate further than desired and thus separate from the housing.

In the prior art several different modifications were made to the bottom plate to solve this problem For example the bottom plate was made thicker in the region where tumbler hits the bottom plate. In the present invention the second bottom plate contact surface 54 hits the edge 31 of the bottom plate thereby being prevented from further travel by the edge. This feature provides the entire length of the bottom plate as a brace to prevent the tumbler from further travel and from becoming separated from the housing.

I claim:

1. A vent stop for use with a sliding member, the vent stop comprising:

a housing adapted to be disposed in a recess, said housing including a cavity with a bottom plate therein, said bottom plate having a top surface forming at least a portion of an inside surface of said cavity and an edge, said edge being generally transverse to the top surface of the bottom plate; said edge extending from said top surface of the bottom plate to a bottom surface of said bottom plate, said edge forming at least one wall of an opening in said bottom plate;

a tumbler disposed in said cavity, said tumbler including a protruding apex at the top thereof;

a pivot means for pivotally securing said tumbler to said housing for movement between an extended position where a front face of said tumbler overlies an edge of the sliding member to prevent movement of the sliding member past the front face of the tumbler, and a retracted position within said cavity where the sliding member can be moved past the tumbler, said pivot means extending from said housing, said pivot means having an upper surface and a lower surface, and wherein said tumbler has a front and a rear end, first and second pivot members extending from the rear end of said tumbler, and wherein said first pivot member contacts said upper surface of said pivot means when said tumbler is in said extended position and said second pivot member contacts said lower surface of said pivot means when said tumbler is in an extended position, said tumbler thereby prevented from further travel;

a spring means for biasing said tumbler into said extended position; and wherein said second pivot member of said tumbler contacts said pivot means when said tumbler is in a retracted position and said apex of said tumbler contacts said faceplate with said tumbler in a retracted position, said tumbler thereby being prevented from further travel.

2. A vent stop according to claim 1 wherein the housing has a face plate and first and second housing members extending from said faceplate and wherein said bottom plate extends from at least one of said housing members.

3. A vent stop according to claim 2 wherein said first and second housing members are generally perpendicular to said faceplate and at least a portion of said bottom member is generally parallel to said face plate.

4. The vent stop according to claim 1 wherein said sliding member is a sash in a double hung window.

5. The vent stop according to claim 1 wherein the sliding member is a sash in a window.

6. The vent stop according to claim 1 wherein the sliding member is a sash in a sliding window.

7. The vent means according to claim 1 wherein said sliding member is a door.

8. A vent stop according claim 1 wherein the force of said tumbler on said bottom plate is parallel to the top surface of said bottom plate when said tumbler is in an extended position.

9. A vent stop for use with a sliding member comprising:

a housing adapted to be disposed in a recess, said housing including a cavity formed by a faceplate; first and second housing members extending from said faceplate; and a bottom plate, said bottom plate extending from at least a portion of a housing member and thereby creating an edge;

a tumbler disposed in said cavity, said tumbler including a protruding apex at the top thereof a pivot means extending from at least one of said first and second housing members for pivotally securing said tumbler to said housing for tumbler movement between an extended position where a front face of said tumbler overlies an edge of the sliding member to prevent movement of the sliding member past the front face of the tumbler, and a retracted position within said housing cavity where the sliding member can be moved past the tumbler;

a spring means for biasing said tumbler into said extended position; and wherein said tumbler has a front end and a rear end, said rear end having a first pivot member and a second pivot member extending therefrom, and wherein said first pivot member contacts said pivot means when said tumbler is in said extended position and said second pivot member having a bottom plate contact surface that contacts said edge of said bottom plate when said tumbler is in an extended position, said tumbler thereby being prevented from further travel; said second pivot member contacting said pivot means when said tumbler is in a retracted position and said apex of said tumbler contacting said bottom surface of said faceplate with said tumbler in a retracted position, said tumbler thereby prevented from further travel.

10. A vent stop according to claim 9 wherein the housing further comprises a front wall and rear wall, said front and rear walls extending from said faceplate, said front and rear walls also connecting to at least one of said first and second housing members.

11. A vent stop according to claim 9 wherein said first and second housing members are generally perpendicular to said faceplate and at least a portion of a top surface of said bottom plate is generally parallel to said face plate.

12. A vent stop according to claim 11 wherein said faceplate has a top surface and a bottom and side surface, and an opening, said face plate being generally perpendicular to the top surface of said bottom plate.

13. A vent stop according claim 11 wherein the force of said tumbler on said bottom plate is parallel to the top surface of said bottom plate when said tumbler is in an extended position.

14. The vent stop according to claim 9 wherein said sliding member is a sash in a double hung window.

15. The vent stop according to claim 9 wherein the sliding member is a sash in a window.

16. The vent stop according to claim 9 wherein the sliding member is a sash in a sliding window.

17. The vent means according to claim 9 wherein said sliding member is a door.

18. A vent stop for use with a sliding member comprising:

a housing adapted to be disposed in a recess, said housing including a cavity with a bottom plate, said bottom plate having a top surface forming at least a portion of an inside surface of said cavity and an edge, said edge being generally transverse to the top surface of the bottom plate, said housing also having a face plate and first and second housing members extending from said faceplate, wherein said bottom plate extends from at least one of said housing members, and wherein said first and second housing members are generally perpendicular to said faceplate and at least a portion of said bottom member is generally parallel to said face plate and;

a tumbler disposed in said cavity having a front face and a rear face, said tumbler including a protruding apex at the top thereof;

a pivot means for pivotally securing said tumbler to said housing for movement between an extended position where a front face of said tumbler overlies an edge of the sliding member to prevent movement of the sliding member past the front face of the tumbler, and a retracted position within said cavity where the sliding member can be moved past the tumbler;

a spring means for biasing said tumbler into said extended position; and wherein said tumbler has a first pivot member and a second pivot member extending from said rear face of said tumbler, and wherein said first pivot member contacts said pivot means when said tumbler is in an extended position and said second pivot member has a bottom plate contact surface that contacts said edge of the bottom plate when said tumbler is in an extended position, said edge extending from a top surface of said bottom plate to the bottom surface of said bottom plate, said edge forming at least one wall of an opening in said bottom plate, said tumbler thereby being prevented from further travel by the edge.

19. The vent stop according to claim 18 wherein said sliding member is a sash in a double hung window.

20. The vent stop according to claim 18 wherein the sliding member is a sash in a window.

21. The vent stop according to claim 18 wherein the sliding member is a sash in a sliding window.

22. The vent means according to claim 18 wherein said sliding member is a door.

23. A vent stop according to claim 18 wherein a force of said tumbler on said bottom plate when said tumbler is in an extended position.

24. A vent stop according to claim 18 wherein a pin is extending from said housing, and said pin fits in a cavity between the first member and the second member and wherein said tumbler pivots around said pin.

25. The vent stop according to claim 24 wherein said pin has a top surface and a bottom surface and wherein said first pivot member contacts said top surface of said pin when said tumbler is in said extended position and said second pivot member contacts said bottom surface of said pin when said tumbler is in said retracted position.

26. The vent stop according to claim 18 wherein said second pivot member contacts said pivot means when said tumbler is in a retracted position and said apex of said tumbler contacts said faceplate with said tumbler in a retracted position, said tumbler thereby prevented from further travel.

27. A vent stop for use with a sliding member and adapted to be partly disposed in a recess of the sliding member, where the vent stop comprises:

a housing, said housing including a cavity formed by a faceplate, said faceplate having a top surface and a bottom and side surface, and an opening; first and second housing members extending from said faceplate; and a bottom plate, said bottom plate extending from at least a portion of a housing member and thereby creating an edge;

a tumbler disposed in said cavity, said tumbler including a protruding apex at the top thereof;

a pivot means extending from at least one of said first and second housing members for securing said tumbler to said housing for tumbler movement between an extended position, and a retracted position within said housing cavity;

a spring means for biasing said tumbler into said extended position;

and wherein said tumbler has a front end and a rear end, said rear end having a first pivot member and a second pivot member extending therefrom, and wherein said first pivot member contacts said pivot means when said tumbler is in said extended position and said second pivot member having a bottom plate contact surface that contacts said edge of said bottom plate when said tumbler is in an extended position, said tumbler thereby being prevented from further travel; said second pivot member contacting said pivot means when said tumbler is in a retracted position and said apex of said tumbler contacting said bottom surface of said faceplate with said tumbler in a retracted position, said tumbler thereby prevented from further travel.

* * * * *